US006702315B2

(12) United States Patent
Barbieri et al.

(10) Patent No.: US 6,702,315 B2
(45) Date of Patent: Mar. 9, 2004

(54) METHODS AND APPARATUS FOR RESISTING GLIDING DEVICE RUNAWAY

(75) Inventors: G. Scott Barbieri, Middlebury, VT (US); Hubert S. Schaller, Burlington, VT (US); Edward Giard, Jericho, VT (US); Benjamin Beck, Boston, MA (US); Douglas Marsden, Marblehead, MA (US); David G. Harting, Needham, MA (US); Baron C. Brandt, Chelsea, MA (US); John Earle, Cliffside Park, NJ (US)

(73) Assignee: The Burton Corporation, Burlington, VT (US)

( * ) Notice: Subject to any disclaimer, the term of this patent is extended or adjusted under 35 U.S.C. 154(b) by 30 days.

(21) Appl. No.: 09/882,366

(22) Filed: Jun. 15, 2001

(65) Prior Publication Data

US 2002/0190501 A1 Dec. 19, 2002

(51) Int. Cl.[7] ..... A63C 7/00

(52) U.S. Cl. ..... 280/605; 280/11.21; 188/6; 188/128

(58) Field of Search ..... 188/5, 6, 7, 8, 188/128; 280/604, 605, 11.216, 11.21, 14.25, 14.27, 28.11, 617, 618, 14.21

(56) References Cited

U.S. PATENT DOCUMENTS 1,618,221 A * 2/1927 Pertram ..... 188/109
3,519,284 A * 7/1970 Toki ..... 188/8
4,678,201 A * 7/1987 Williams ..... 280/620
4,759,565 A * 7/1988 Arduin et al. ..... 280/605
5,085,453 A * 2/1992 Bildner ..... 280/612
5,573,257 A * 11/1996 Olivieri ..... 280/28.11
6,007,101 A * 12/1999 Pritchard et al. ..... 280/605

FOREIGN PATENT DOCUMENTS

EP 1103289 A1 5/2001

OTHER PUBLICATIONS

Two pages from Internet web site, www.bideck.com, printed Nov. 27, 2001.

One page from Internet web site, www.bideck.com, printed Dec. 14, 2001.

* cited by examiner

*Primary Examiner*—Avraham Lerner
(74) *Attorney, Agent, or Firm*—Wolf, Greenfield & Sacks, P.C.

(57) ABSTRACT

A braking feature is provided that can resist gliding board runaway, i.e., uncontrolled gliding without a rider, or other movement of a gliding board, e.g., a gliding device having no foot bindings. The braking feature may always be active to resist gliding board movement, and/or resist movement only when a rider is not supported on the gliding device. Activation of a braking feature may be delayed. The braking feature may be controlled based on a force urging a bottom surface of the gliding device into contact with the gliding surface, e.g., the braking feature may be deactivated if the weight of a rider is supported on the gliding device. A force that deactivates a braking feature may be made adjustable, e.g., to accommodate riders of different weights or to provide different braking feature responses.

30 Claims, 6 Drawing Sheets

METHODS AND APPARATUS FOR RESISTING GLIDING DEVICE RUNAWAY

FIELD OF THE INVENTION

This invention relates to methods and apparatus for resisting gliding device runaway.

BACKGROUND OF THE INVENTION

Runaway of a gliding device, such as a ski or snowboard, that occurs when the gliding device is separated from a rider can be a problem, particularly on steep, well-groomed ski trails. For example, an unrestrained ski that becomes separated from a skier, e.g., when the skier falls and the ski binding releases the skier's boot, may travel at high speed down the ski slope once liberated and cause injury or damage.

Various restraining devices, such as straps or leashes that connect a ski to the skier's leg or boot, or ski brakes, have been used to resist ski runaway. Commonly-known ski brakes operate so that braking arms are retracted when the skier's boot is secured to the ski by the ski bindings. When the bindings release the ski boot, the arms extend below the ski base to resist travel of the ski. In many ski brake designs, the skier's boot depresses a pedal as the boot is engaged by a heel binding causing the braking arms to be retracted. Release of the boot by either the heel or toe binding frees the pedal from contact with the ski boot, and allows the braking arms to extend below the ski base.

SUMMARY OF THE INVENTION

Embodiments in accordance with various aspects of the invention provide a braking feature that resists gliding device runaway. In one aspect of the invention, the gliding device does not include any foot bindings or other device to secure a rider's feet or other body portion to the gliding device. Thus, various aspects of the invention may be useful in preventing runaway of gliding devices that do not use bindings to secure a rider to the device, such as a snowdeck, snowskate, sled, skateboard, etc.

In one aspect of the invention, a gliding board includes an upper surface constructed and arranged to support a rider's feet while the rider is standing without a binding to secure at least one foot to the upper surface, and a bottom surface constructed and arranged to contact a gliding surface. A braking feature is always in an active state to resist movement of the gliding board along the gliding surface. This is in contrast, for example, to a conventional ski brake that is put into an inactive state and does not resist movement of the ski when a ski boot is engaged with the ski binding.

In another aspect of the invention, a gliding device includes an upper surface constructed and arranged to support a rider's feet while the rider is standing without a binding to secure at least one foot to the upper surface, and a bottom surface adapted to contact a gliding surface. A braking feature resists movement of the gliding board along the gliding surface when the rider is not supported by the upper surface.

In another aspect of the invention, a gliding device for supporting a rider when sliding on a surface includes a runner having an upturned end, a middle portion and a bottom surface that contacts a gliding surface. A deck is elevated from the runner, and has an upper surface that supports a rider and a longitudinal axis. A spacer is secured to the runner and to the deck so that forces applied by a rider on the deck are transmitted to the runner, and a braking feature is adapted to resist movement of the gliding device sliding on the gliding surface.

In another aspect of the invention, a gliding device for supporting a rider when sliding on a surface includes a runner having an upturned end, a middle portion and a bottom surface that contacts a gliding surface. A deck is elevated from the runner, and has an upper surface that supports a rider and a longitudinal axis. A spacer is secured to the runner and to the deck so that forces applied by a rider on the deck are transmitted to the runner. A braking feature adapted to resist movement of the gliding device sliding on the gliding surface may be controlled based on a force urging the bottom surface into contact with the gliding surface.

In another aspect of the invention, a gliding device for supporting a rider when sliding on a surface includes a runner having an upturned end, a middle portion and a bottom surface that contacts a gliding surface. A deck is elevated from the runner, and has an upper surface that supports a rider. A spacer is secured to the runner and to the deck so that forces applied by a rider on the deck are transmitted to the runner. A braking feature adapted to resist movement of the gliding device sliding on the gliding surface may be controlled based on a separation distance between a portion of the deck and a portion of the runner.

In another aspect of the invention, a gliding device for supporting a rider when sliding on a surface includes a runner having an upturned end, a middle portion and a bottom surface that contacts a gliding surface. A deck is elevated from the runner, and has an upper surface that supports a rider. A spacer is secured to the runner and to the deck so that forces applied by a rider on the deck are transmitted to the runner, and a braking feature adapted to resist movement of the gliding device sliding on the gliding surface may be deactivated by an adjustable deactivation force.

In other aspect of the invention, a gliding device for supporting a rider when sliding on a surface includes a runner having an upturned end, a middle portion and a bottom surface that contacts a gliding surface. A deck is elevated from the runner, and has an upper surface that supports a rider. A spacer is secured to the runner and to the deck so that forces applied by a rider on the deck are transmitted to the runner. A braking feature includes a braking element adapted to resist movement of the gliding device sliding on the gliding surface, and a delay element adapted to delay activation of the braking element for a period of time after the rider is no longer supported by the deck.

In another aspect of the invention, a gliding device for supporting a rider when sliding on a surface includes a runner having an upturned end, a middle portion and a bottom surface that contacts a gliding surface. A deck is elevated from the runner, and has an upper surface that supports a rider and a longitudinal axis. A spacer is secured to the runner and to the deck so that forces applied by a rider on the deck are transmitted to the runner. Braking means are provided for resisting movement of the gliding device on the gliding surface.

In another aspect of the invention, a method for resisting movement of a gliding device includes providing a gliding device having a runner with a bottom surface that contacts a gliding surface, a deck elevated from the runner, and a spacer secured to the runner and to the deck so that forces applied by a rider on the deck are transmitted to the runner.

Movement of the gliding device on the gliding surface may be resisted by engaging a portion of the gliding device with the sliding surface.

These and other aspects of the invention will be apparent from the following description and appended claims.

BRIEF DESCRIPTION OF THE DRAWINGS

Illustrative embodiments are described in connection with the following drawings, in which like numerals reference like elements, and wherein.

DETAILED DESCRIPTION

Figure 1:
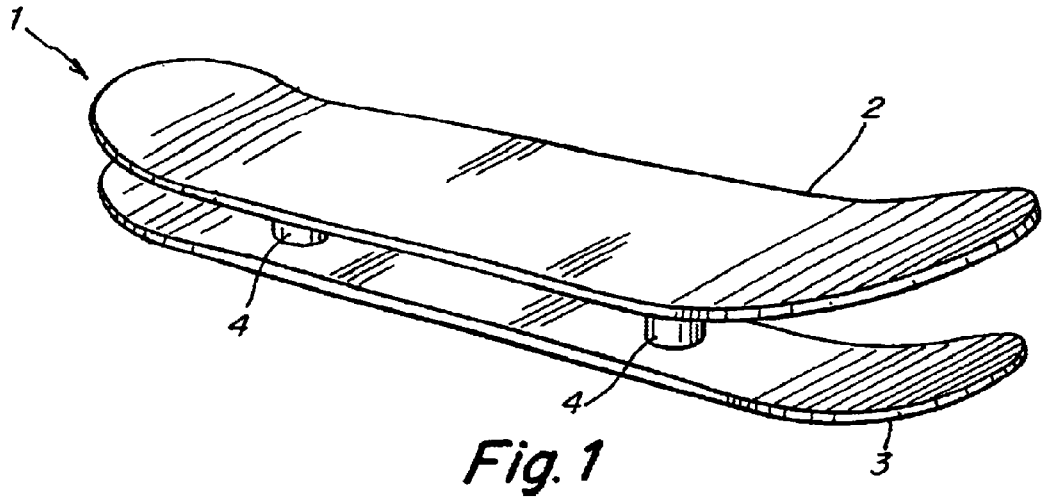
FIG. 1 is a perspective view of a snowdeck in an illustrative embodiment in accordance with an aspect of the invention.

Illustrative embodiments in accordance with various aspects of the invention are described below. Although several of the illustrative embodiments are described in connection with a snowdeck, such as that shown in FIG. 1, several of the illustrative embodiments and various aspects of the invention may be used with other gliding devices, such as skis, snowboards, sleds, snow scooters, skateboards, and other devices used for gliding on snow, ice, asphalt, sand, grass or other suitable surfaces.

In some aspects of the invention, the inventors have developed braking features to resist gliding board movement on a gliding surface where the gliding board does not include foot bindings or other devices to physically attach a rider to the gliding device. Conventional braking devices may rely on the detachment of a rider from the binding device to activate the braking device. The inventors have found that such devices are not useful for gliding devices, such as a snowdeck, that does not include foot bindings. Although straps, tethers or other devices have been used to attach a rider to a gliding device, a gliding device such as a snowdeck presents a special problem because riders perform tricks in which the rider's feet move on the snowdeck or are intentionally separated at least momentarily from the snowdeck. A strap or tether that connects the rider's leg or other body portion to the snowdeck may potentially interfere with such tricks. Thus, in some cases a braking feature that prevents movement of the gliding device without a tether or other physical connection between the rider and the gliding device may be preferable. Although various aspects of the invention described herein may be used with gliding devices having no foot bindings or similar devices, these aspects of the invention may be useful in gliding devices that have foot bindings or other devices that attach a rider to the gliding device.

Illustrative embodiments in accordance with various aspects of the invention described below include a gliding device, such as a snowdeck, that has a braking feature to resist runaway of the gliding device. The braking feature may resist gliding of the device with and/or without a rider using the gliding device. For example, the presence of the rider using the gliding device may deactivate the braking feature which then becomes effective when the rider is no longer mounted on the gliding device, e.g., the rider falls and becomes separated from the gliding device. Alternately, the braking feature may always be in an active state to resist gliding, but the braking feature's resistance to gliding may be overcome by a force of the rider, e.g., a force of gravity on the rider, to move the gliding device along a gliding surface.

In one aspect of the invention, the braking feature included with the gliding device may be a physical feature or condition of the gliding device. For example, "fish scale" features or similar features on the base or other bottom surface of the gliding device may resist movement on a gliding surface. Alternately, the gliding device may be arranged to tilt on its side or turn over without the presence of a rider. Tilting of the gliding device may cause portions of the device to contact the gliding surface and resist movement on the gliding surface. In contrast, the braking feature may include active braking devices that resist gliding movement of the device. For example, the braking feature may include one or more braking arms that depend below the base or other gliding surface of the gliding device. The braking arm(s) may be resilient to resist movement of the gliding device, yet still allow relatively unimpeded use of the gliding device by a rider. The braking arm(s) may be retractable, e.g., de-activated by the rider's weight on the gliding device, to allow unimpeded riding. The braking arm may be deployed once the rider is no longer suitably positioned on the gliding device, and in some cases deployment of the braking arm can be delayed, e.g., to prevent brake activation while a rider is momentarily separated from the device during a trick or other maneuver.

FIG. 1 shows an illustrative embodiment of a snowdeck in accordance with an aspect of the invention. In this embodiment, the snowdeck 1 includes a deck 2 that is attached to, and vertically spaced from, a runner 3 by spacers 4. The snowdeck 1 may be maneuvered in much the same way as a conventional skateboard, e.g., the rider may turn the snowdeck 1 by tilting the snowdeck 1 about its longitudinal axis. The snowdeck 1 and its various component parts may be constructed and/or arranged in any suitable way, such as that described in U.S. patent application Ser. No. 09/733,626, filed Dec. 8, 2000, which is hereby incorporated by reference in its entirety.

Figure 2:
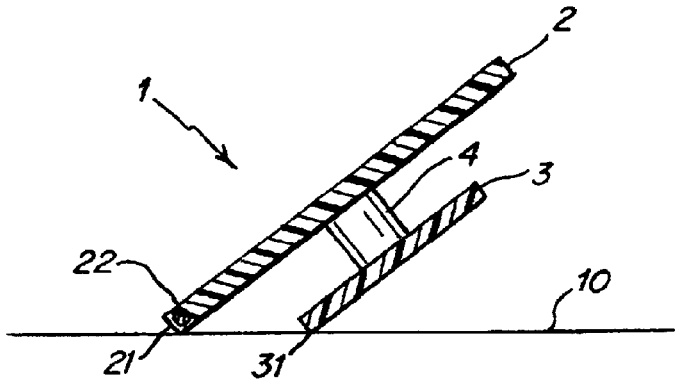
FIG. 2 is an end view of a snowdeck having a braking feature that tilts the snowdeck about a longitudinal axis.

In one aspect of the invention, a braking feature may be a passive feature that includes no moving parts, and includes one or more design features of the gliding device. For example, FIG. 2 shows a sectional end view of a snowdeck 1 having a braking feature in which the snowdeck 1 is arranged to tilt about a longitudinal axis when a rider is not supported on the upper surface of the deck 2. In this embodiment, the center of gravity of the snowdeck 1 is arranged outboard of a lower edge 31 of the runner 3 so that when the rider is not supported on the deck 2, the snowdeck 1 rotates, or tilts, about the lower edge 31. When the rider is positioned on the deck 2, the center of gravity of the rider/snowdeck combination may be positioned between the lower edges 31 of the runner 3 so that the snowdeck 1 may be ridden without substantial interference of the tendency of the snowdeck 1 to tilt. Tilting of the snowdeck 1 urges the bottom surface of the runner 3 out of contact with a gliding surface 10 and causes a lateral edge 21 of the deck to contact the gliding surface 10 and/or the snowdeck 1 to flip over onto the deck 2. Contact of the lateral edge 21 of the deck 2 with the gliding surface 10 may create friction between the gliding surface 10 and the deck 2 that slows or stops movement of the snowdeck 1 along the gliding surface 10. Tilting of the snowdeck 1 may also cause the snowdeck 1 to turn, e.g., because of the frictional force on the lateral edge 21 and/or a sidecut or other feature of the lower edge 31 that is in contact with the gliding surface 10. Movement of the snowdeck 1 may be resisted by a combination of turning caused by the snowdeck 1 riding on the lower edge 31 as well as frictional contact between the lateral edge 21 of the deck 2 with the gliding surface 10. The lateral surface 21 may include barbs or other friction-enhancing features to resist movement of the snowdeck 1.

Tilting of the snowdeck 1 may be caused in any suitable way. In the embodiment shown in FIG. 2, the deck 2 includes a weighted portion 22 that tends to cause the snowdeck 1 to tilt around the lower edge 31 of the runner 3. The weight and/or arrangement of the weighted portion 22 tends to tilt the snowdeck 1 when no rider is on the deck 2, but preferably does not significantly degrade the riding characteristics, such as the turning response or stability of the snowdeck 1. The weighted portion 22 can take any suitable shape or size, and be positioned in any suitable way in or on the snowdeck 1. For example, the weighted portion 22 may be embedded within the deck 2, attached to the runner 3 or spacer 4, etc. Thus, the weighted portion 22 need not necessarily be a separate component from the deck 2, spacer 4 or runner 3 and may be a portion of the deck 2, etc. that is suitably positioned to cause the snowdeck 1 to tilt. Therefore, the only requirement for the weighted portion 22 is that the center of gravity of the snowdeck 1 be shifted to a position outboard of one of the lower edges 31 or other pivot point for the snowdeck 1.

In another illustrative embodiment, the bottom surface of the runner 3 may include "fish scale" or other surface features to resist runaway or other movement. The term "fish scale" features refers to the type of features found on the runner portion of some waxless cross country skis that provide the ski with grip when climbing an inclined snow slope. The size, orientation and configuration of the fish scale features can vary widely depending on various factors, such as the size and weight of the runner 3 and/or snowdeck 1. For example, fish scale features may be arranged at the contact areas of the runner 3 so that they provide a different resistance to gliding when the snowdeck 1 is moved in different directions. That is, the fish scale features at one end of the snowdeck 1 may provide a maximum resistance to gliding when positioned at the rear end of the snowdeck 1 during travel, and less resistance to gliding when positioned at the forward end during travel. Of course, any surface feature or combination of features may be used that provides a sufficient resistance to gliding board movement, e.g., to resist runaway. Preferably, the surface features provide a resistance to movement that does not substantially affect the performance of the gliding device, and in some cases may enhance its performance. For example, fish scale features at the contact areas of the runner 3 may provide a snowdeck 1 with an improved ability to move in a straight line path during riding.

Figure 3:
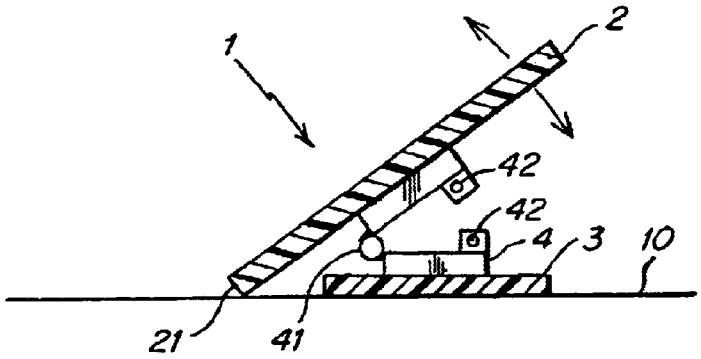
FIG. 3 is an end view of a snowdeck having a hinge connection between the top deck and runner.

In an alternate embodiment, one or more portions of the snowdeck 1 may be arranged to move relative to other portions of the snowdeck 1 and thereby activate a braking feature. For example, FIG. 3 shows an embodiment in which the spacers 4 include a hinge 41 that interconnects the deck 2 and the runner 3. The hinge 41 may be spring-biased so that when a rider is not supported by the deck 2, the hinge 41 biases the deck 2 to rotate away from the runner 3. This rotation may cause a lateral edge 21 of the deck 2 to contact the gliding surface 10 and resist movement of the snowdeck 1. Movement of the deck 2 relative to the runner 3 may also, or alternately, shift a center of gravity of the snowdeck 1 so that the snowdeck 1 tends to tilt or flip over in a manner similar to that in the FIG. 2 embodiment. The spring bias in the hinge 41 is preferably sufficient to move the deck 2 relative to the runner 3, but not strong enough to substantially resist the weight of a rider. Thus, when a rider is supported on the deck 2, the hinge 41 closes to a riding position, e.g., where the upper surface of the deck 2 and the bottom surface of the runner 3 are approximately parallel.

In some cases, the hinged connection between the deck 2 and the runner 3 may hamper a rider's ability to maneuver the snowdeck 1. For example, when a rider attempts to tilt the snowdeck 1 to initiate a turn, the hinge 41 may rotate and prevent transfer of the tilting force of the rider's feet to the runner 3. To counteract this tendency, the snowdeck 1 may instead have a relatively stiff connection between the deck 2 and the runner 3 similar to that in the FIG. 2 embodiment. Braking may be provided by a portion of the deck 2 or other braking member that is pivotally mounted to the deck 2 by a hinge 41. For example, the deck 2 may be split into two stacked portions that are attached together by a spring-biased hinge 41. The lower deck portion may be rigidly connected to the runner 3 by the spacers 4 while the upper deck portion or other braking member is hinged to the lower deck portion. The upper deck portion or other braking member may be rotated to lie flat on the deck 2 or within recesses in the deck 2 and held in place against the spring bias of the hinge 41 by the rider's feet during riding. When the rider is no longer supported on the upper surface of the deck 2, e.g., if the rider falls, the hinged portions may rotate under the spring bias of the hinge 41 away from the lower deck portion to activate a braking feature. Rotation of the hinged portions may shift the snowdeck's center of gravity and cause the snowdeck 1 to tilt and/or the upper deck portion or other braking member may rotate to contact the gliding surface 10 and resist gliding movement. As a result, a rigid connection may be maintained between the deck 2 and the runner 3 to provide responsive turning characteristics while also providing a braking feature.

Alternately, the hinge 41 in the FIG. 3 embodiment may be selectively locked in a riding position to allow the rider to transfer tilting force to the runner 3 during riding, and unlocked to allow the braking feature to be activated. For example, the hinge 41 in the FIG. 3 embodiment may include hinge plates having holes 42 to receive a retaining pin (not shown). Thus, when the deck 2 is rotated toward the runner 3, the holes 42 may be aligned and the retaining pin inserted through the aligned holes 42. Once the pin is in place, rotation of the deck 2 relative to the runner 3 is prevented until the pin is withdrawn. The pin may be attached to a rip-cord or other tether and pulled from the holes 42 if the rider falls from the snowdeck 1 during riding. For example, the rip-cord may be attached to the rider's leg or hand so that if the rider is separated from the snowdeck 1, the attached rip-cord pulls the pin from the holes 42.

In another illustrative embodiment, a gliding device may include one or more resilient braking elements that urge at least a portion of the bottom surface of the gliding device away from the gliding surface or otherwise contact a gliding surface to resist movement of the snowdeck. A resilient braking element may be attached to the gliding device and contact the gliding surface, thereby creating a frictional force that resists gliding. The braking element may be active with and/or without the presence of the rider. If the braking element is active while the rider uses the gliding device, the frictional force of the resilient braking element may be overcome by the force of a rider, e.g., the force of gravity on the rider pulling the rider and the gliding device down a gliding surface.

Figure 4:
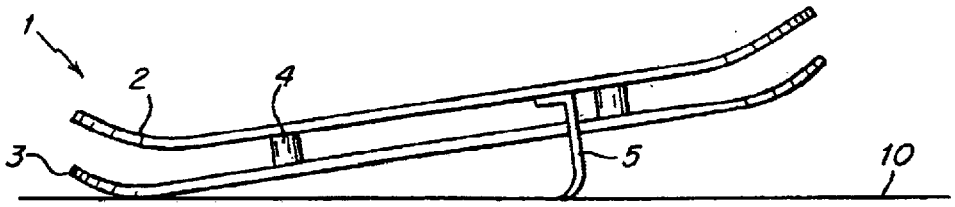
FIG. 4 is a side view of a snowdeck having a resilient member that resists contact of the runner base with a sliding surface.

FIG. 4 shows a side view of an illustrative embodiment including a resilient portion 5 that is attached to the deck 2 and extends below the bottom surface of the runner 3. The resilient portion 5 may be made of any suitable material such as a plastic, metal, rubber or other material or combination of materials with suitable properties. The resilient portion 5 may have sufficient strength to urge the bottom surface of the runner 3 away from the gliding surface 10 and thereby resist movement of the snowdeck 1 along the gliding surface 10. The resilient portion 5 may have sufficient strength and length to tilt the snowdeck on its side, e.g., to a position similar to that shown in FIG. 2. Alternately, the resilient portion 5 may not necessarily have sufficient strength to lift the snowdeck 1 off of the gliding surface 10, but instead have barbs, spurs or other features that are resiliently urged against the gliding surface 10 to resist movement of the snowdeck 1. If the resilient portion 5 has sufficient strength to lift the snowdeck 1 off of the gliding surface 10, the resilient portion 5 preferably does not have sufficient strength to substantially resist the weight of a rider on the deck 2. That is, once a rider is supported on the deck 2, the resilient portion 5 deforms to allow the runner 3 to contact the gliding surface 10. In any case, the resilient portion 5's resistance to movement of the snowdeck 1 along the gliding surface 10 may be sufficient to prevent a runaway snowdeck 1, but not sufficient to significantly affect the riding performance of the snowdeck 1.

Figure 5:
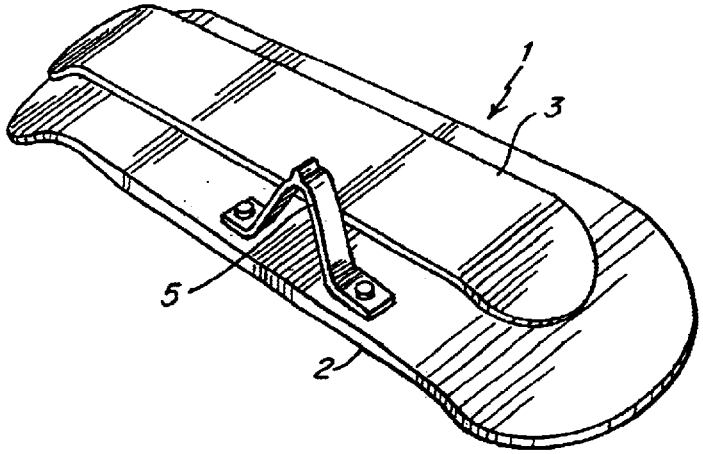
FIG. 5 is a perspective bottom view of a snowdeck having a resilient member similar to that shown in FIG. 4.
Figure 6:
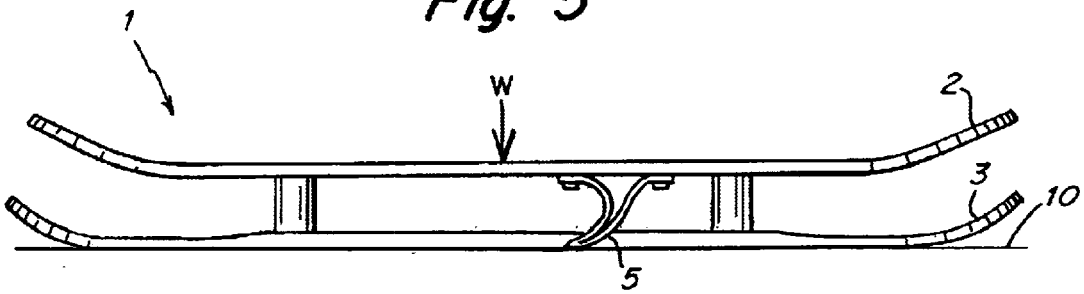
FIG. 6 is a side view of a snowdeck having the resilient member shown in FIG. 5 in a weighted condition.

FIG. 5 shows a perspective bottom view of a snowdeck 1 having a strap-type resilient portion 5. In this illustrative embodiment, a resilient strap that forms the resilient portion 5 is attached at its ends to the deck 2 so that the mid-portion of the strap is supported away from the deck 2 at a position below the bottom surface of the runner 3. FIG. 6 shows a side view of the FIG. 5 embodiment when the snowdeck 1 is supporting the weight W of a rider on the deck 2. The weight W of the rider deforms the resilient portion 5 so that the runner 3 may contact the gliding surface 10. As with the FIG. 4 embodiment, the portion of the resilient portion 5 that contacts the gliding surface 10 may include spikes, barbs or other features that tend to resist movement of the snowdeck 1 along the gliding surface 10. The spikes, barbs or other features may be molded into a plastic strap, or may be otherwise attached to the resilient portion 5, e.g., by rivets or other mechanical fasteners. When the snowdeck 1 is unweighted, the resilient portion 5 may elastically recover to a shape near that shown in FIG. 5 and optionally urge the bottom surface of the runner 3 away from the gliding surface 10. Since the snowdeck 1 may be constructed and arranged to be ridden in either direction, e.g., either toward the left or right as shown in FIG. 6, the resilient portion 5 may be suitably arranged to accommodate the variety of ways that the snowdeck 1 may be ridden. The resilient portion 5 may include preferential folds, bends or other features that present a relatively smooth surface on the gliding surface 10 when the rider is supported on the snowdeck 1 so that the resilient portion 5 minimizes its resistance to gliding. However, when the snowdeck is unweighted, the resilient portion 5 may unfold or otherwise recover to present a braking surface, such as one including spurs, barbs, etc., on the gliding surface 10. For example, the peak of the resilient portion 5 in its undeformed state shown in FIG. 5 may include spikes, while parts of the resilient portion away from the peak have a relatively smooth surface. Thus, when the resilient portion 5 is deformed as shown in FIG. 6, a smooth surface rather than the spikes at the peak are in contact with the gliding surface 10. When the snowdeck 1 is unweighted, the resilient portion 5 may recover and force the spikes into contact with the gliding surface 10.

Figure 7:
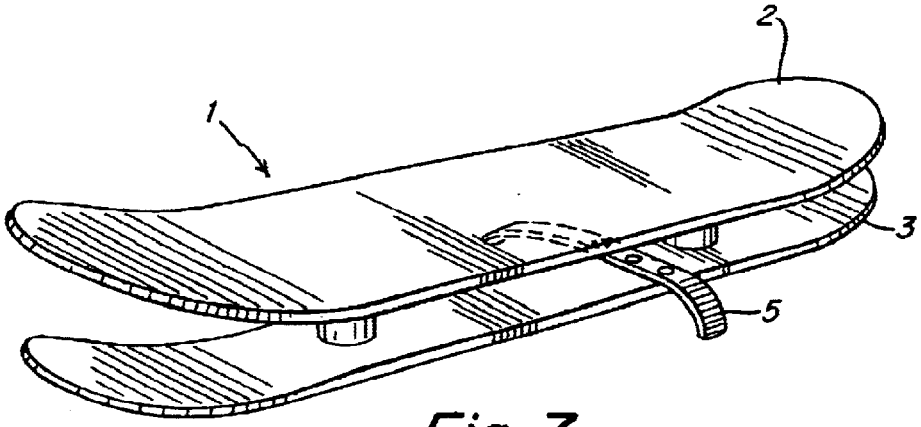
FIG. 7 is a perspective view of a snowdeck having a resilient member extending laterally from the runner.

The resilient braking element need not necessarily be secured to the deck 2 as shown in FIGS. 4–6, but may be secured to other portions of the snowdeck 1. For example, the illustrative embodiment shown in FIG. 7 includes a resilient portion 5 that is secured to the runner 3 and extends laterally outward and downward from the runner 3. In this embodiment, the resilient portion 5 extends below the bottom surface of the runner 3 to resist movement of the snowdeck 1. As in other embodiments, the resilient portion 5 may urge the snowdeck 1 away from contact with a gliding surface 10 when a rider's weight is not supported on the deck 2. The ends of the resilient portion 5 that contact the gliding surface 10 may also have barbs, spikes or other features to resist movement, and the resilient portion 5 may be made of any suitable material or combination of materials. The resilient portion 5 may be secured to the runner 3 in any suitable way, such as by screws, adhesive or any other mechanical fastener. As in the other embodiments, the resilient portion 5 may also be formed integrally with any portion of the snowdeck 1, such as the spacers 4, the runner 3 or the deck 2.

Figure 8:
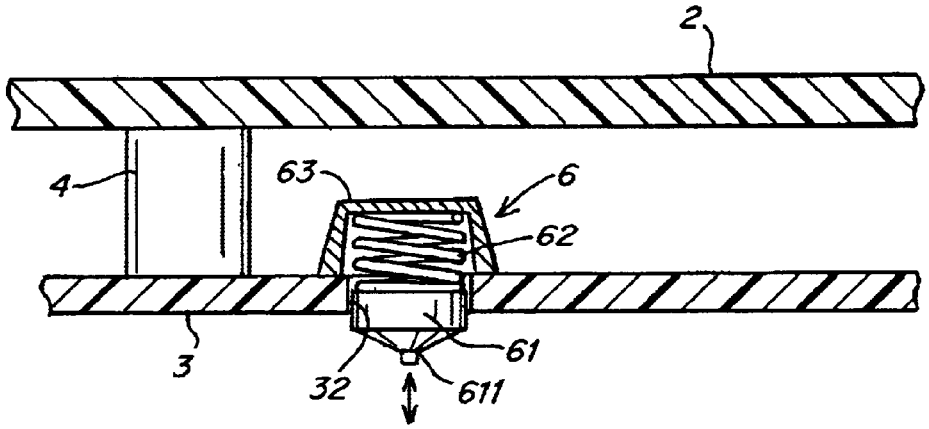
FIG. 8 is a sectional side view of a plunger-type braking device in accordance with one aspect of the invention.

FIG. 8 shows another illustrative embodiment of a braking device in accordance with an aspect of the invention. In this illustrative embodiment, a braking element 61 is biased in a downward direction by a spring 62 within a housing 63. The housing 63 may be fastened to an upper surface of the runner 3 over a hole 32 formed in the runner 3. Thus, the spring 62 can urge the braking element 61 against the gliding surface 10 to resist movement of the snowdeck 1 along the gliding surface 10. In this embodiment, the braking element 61 has a conical end 611 that engages the gliding surface 10 to resist movement. However, the braking element 61 may have any suitable shape. For example, the braking element 61 may have a skeg-type shape that engages the gliding surface 10. That is, the braking element 61 may include a blade-like portion that is oriented in a longitudinal direction along the snowdeck 1, and may be biased to move in a downward direction to resist runaway of the snowdeck 1. In addition, the blade or skeg portion may also provide ride stability, e.g., the blade or skeg portion may cause the snowdeck 1 to travel in a more straight-line path during riding than if the skeg or blade were not present. Similar to the braking element 61 shown in FIG. 8, a braking element 61 having a blade or skeg-like shape may be spring-biased to move vertically relative to the runner 3, or may be biased about a pivot point. The blade or skeg may be positioned near the contact areas, i.e., near the transition from upturned ends of the runner 3 to the running length of the runner 3, to have more effect on ride stability. The blade or skeg portion may have any suitable dimensions, e.g., 1–15 cm long, 1–10 mm wide and 1–30 mm high, and made of any suitable material, such as plastic, metal and/or a composite material. In at least one alternate embodiment, blades or skegs may be provided at both contact areas on the runner 3 and may be fixed in place rather than spring-biased to move relative to the runner 3.

Although the embodiment shown in FIG. 8 depicts a braking device 6 that is positioned away from a spacer 4, the braking device 6 may be formed integrally with one or more spacers 4 on the snowdeck 1. That is, the housing 63 may be formed by a part of the spacer 4 within which the spring 62 and the braking element 61 may be positioned. Although such a feature is not shown, the braking element 61 may include a shoulder or other portion that prevents the braking element 61 and the spring 62 from passing completely through the hole 32 and the runner 3 and/or from extending more than a desired distance below the bottom surface of the runner 3.

Figure 9:
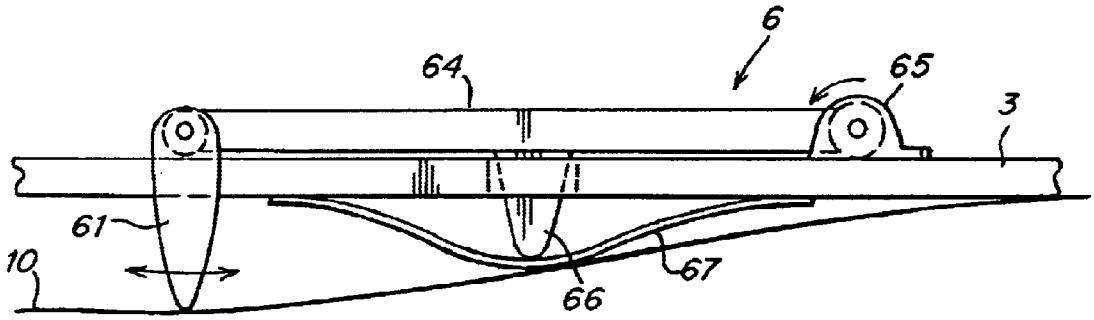
FIG. 9 is a side view of another braking device in accordance with an aspect of the invention.
Figure 10:
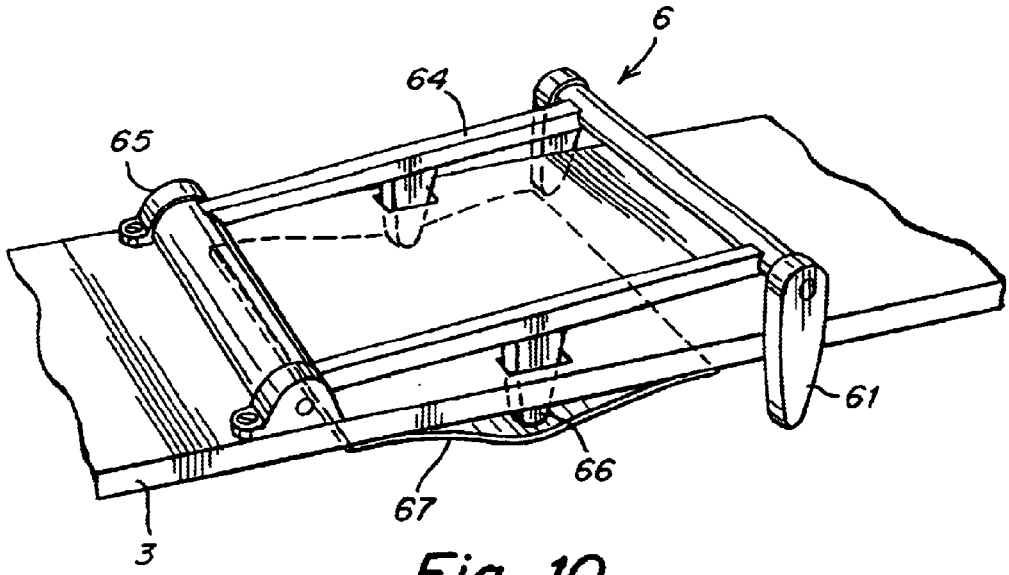
FIG. 10 is a perspective view of the braking device shown in FIG. 9.

In another aspect of the invention, a braking feature may be deactivated by sufficient force urging the gliding device into contact with a gliding surface. The force urging the gliding device into contact with the gliding surface may be the weight of the rider on the gliding device. Once the force is removed, e.g., the rider is no longer supported by the gliding device, the braking feature may be activated. For example, FIGS. 9 and 10 show a side view and a perspective view of another braking device in an illustrative embodiment. In this embodiment, the braking device 6 includes a frame 64 that is pivotally mounted to the runner 3 at a hinge 65. The hinge 65 may be spring-biased so that the frame 64 is biased to rotate in a counterclockwise direction relative to the runner 3 as shown in FIG. 9. The frame 64 includes a pair of arms 66 extending downwardly from the frame 64 and a pair of braking elements 61 attached at an end of the frame 64 opposite the hinge 65. When the weight of a rider is supported on the snowdeck 1, the bottom surface of the runner 3 moves toward the gliding surface 10, which presses upwardly on the arms 66 and rotates the frame 64 so that the braking elements 61 are disengaged from the gliding surface 10. However, when the rider's weight is not supported on the snowdeck 1, the spring force of the hinge 65 rotates the frame 64 to a position approximately like that shown in FIG. 9, thereby engaging the braking elements 61 with the sliding surface 10.

The braking elements 61 and other portions of the braking device 6 may be formed in any suitable way to provide the desired braking features. For example, the braking elements 61 may be attached to the frame 64 so that the braking elements 61 may rotate relative to the frame 64. This rotation may be provided by a pivoting connection, or by the resilient twisting or other deformation of the braking elements 61 or the frame 64. A flexible sheet 67 may be provided under the arms 66 and connected to the runner 3 to minimize or prevent any braking action provided by the arms 66 as a result of the gliding surface pushing upward on the arms 66. The sheet 67 may be a flexible plastic material that is secured to the bottom surface of the runner 3 and separates the arms 66 from the gliding surface 10. Alternately, the ends of the arms 66 that contact the gliding surface may be rounded or otherwise made to minimize any frictional force on the arms in a direction transverse to the direction of movement of the arms 66 relative to the runner 3. As with the other embodiments described herein, the braking device 6 may be made of any suitable materials using any suitable construction technique. For example, the frame 64, arms 66 and braking elements 61 may be molded as a single, unitary member, or assembled from separate parts. Spring bias provided at the hinge 65 may be supplied by a compression or torsion spring, or by elastic deformation of the frame 64 or other portion of the hinge 65. In this embodiment, the arms 66 are shown extending through holes in the runner 3, while the braking elements 61 extend below the runner 3 at opposite lateral edges. Alternately, the braking elements 61 may extend through holes in the runner 3, or the arms 66, as well as the braking elements 61 may be positioned outside the lateral edges of the runner 3.

Figure 11:
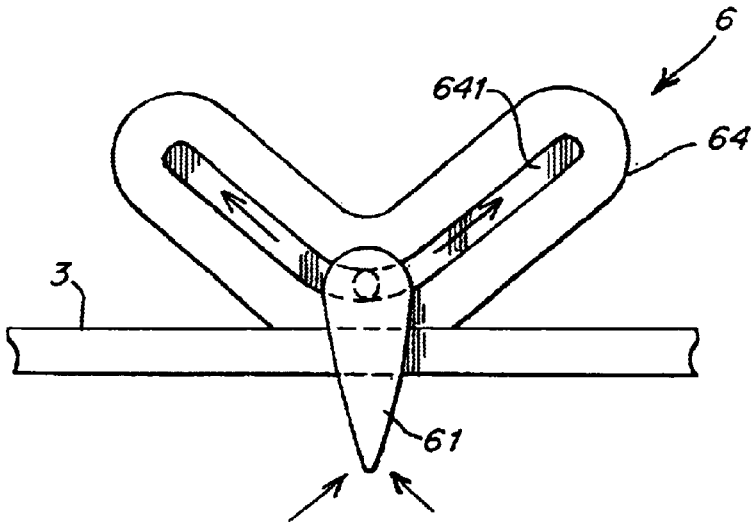
FIG. 11 is a side view of another braking device in accordance with an aspect of the invention.
Figure 12:
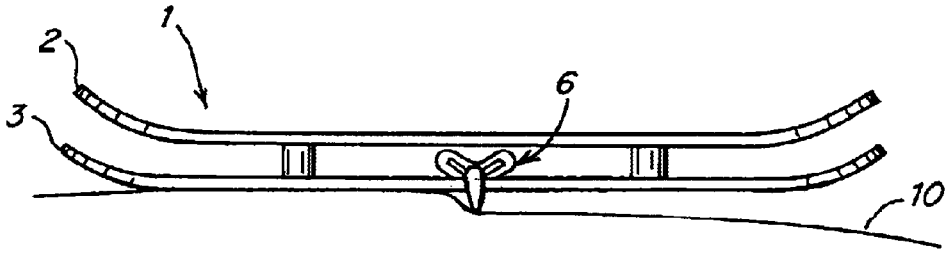
FIG. 12 shows a side view of a snowdeck including the braking device shown in FIG. 11.

In another aspect of the invention, a braking element in a braking device may move transversely relative to a gliding surface to activate and deactivate a braking feature or otherwise change the braking device's resistance to movement of the gliding device. For example, FIGS. 11 and 12 show a side view of yet another braking device 6 in accordance with an aspect of the invention. In this embodiment, the braking device 6 includes a frame 64 having a "V"-shaped slot 641. The frame 64 is mounted to the runner 3 and a braking element 61 may travel along the V-shaped slot 641. Thus, if force is placed on the braking element 61 in a direction generally from left to right, the braking element 61 may travel up the V-shaped slot 641 toward the right. Conversely, if force is directed generally on the braking element 61 from right to left, the braking element 61 may travel to the left up the slot 641. A spring return (not shown) or other similar feature may be provided so that the braking element 61 is urged toward the bottom portion of the V-shaped slot 641 as shown in FIG. 11. Thus, for example, when the braking device 6 is mounted to a snowdeck 1, as shown in FIG. 12, the spring bias on the braking element 61 may cause the element 61 to engage the sliding surface 10 to resist movement of the snowdeck 1. When a rider is supported on the snowdeck 1, force of the gliding surface 10 on the braking element 61 may cause the braking element 61 to travel up one of the portions of the V-shaped slot 641 so that braking element 61 provides little or no resistance to movement of the snowdeck 1. In addition to, or instead of moving within the V-shaped slot 641, the braking element 61 may be mounted to rotate about a pivot point above the bottom surface of the runner 3. As with other embodiments described above, the braking element 61 may resiliently rotate under a spring or other resilient bias so that a rider may use the snowdeck 1 relatively unimpeded by the braking element 61, but so that the braking element 61 resists runaway of the snowdeck 1. The braking element 61 and other portions of the braking device may be made of any suitable material, such as metal or plastic, and may have spurs, barbs or other features to enhance or otherwise control the braking resistance of the device 6.

Figure 13:
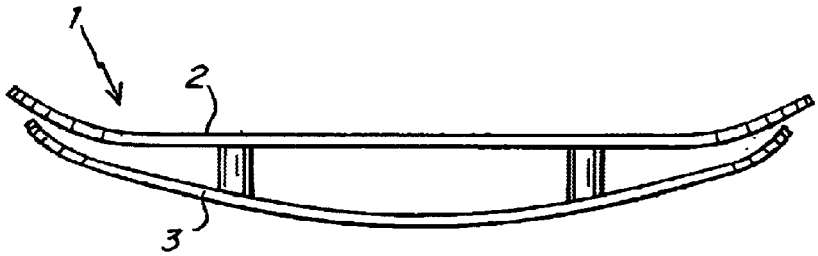
FIG. 13 is a side view of a snowdeck with a braking feature in the form of a high degree of reverse camber in the runner.

In another aspect of the invention, a braking feature may include passive structural features of the gliding device, but unlike the FIG. 2 embodiment, the passive structural feature may include a movable portion. For example, FIG. 13 shows a snowdeck 1 having a runner 3 with a high degree of reverse camber, i.e., the runner 3 has a relatively high radius of curvature along its length. When a rider is supported on the deck 2, the runner 3 is sufficiently flexible to flatten under the rider's weight to provide the desired riding characteristics, such as turning capability and stability. However, when a rider's weight is not supported on the deck 2, the runner 3 returns to its curved shape. In this configuration, the curvature of the runner 3 can cause the snowdeck 1 to become unstable, and thus to tip over, thereby resisting snowdeck runaway. The degree of curvature of the runner 3 can be any suitable value or set of values so that the desired braking or other resistance to movement is provided. In addition, the reverse camber of the runner 3 may be combined with any other suitable braking features. For example, the runner 3 may also be curved in a lateral direction in addition to, or instead of being curved in a longitudinal direction as shown in FIG. 13. Curvature in the lateral direction may cause the snowdeck 1 to roll over or tilt when the rider is not supported on the deck 2.

Figure 14:
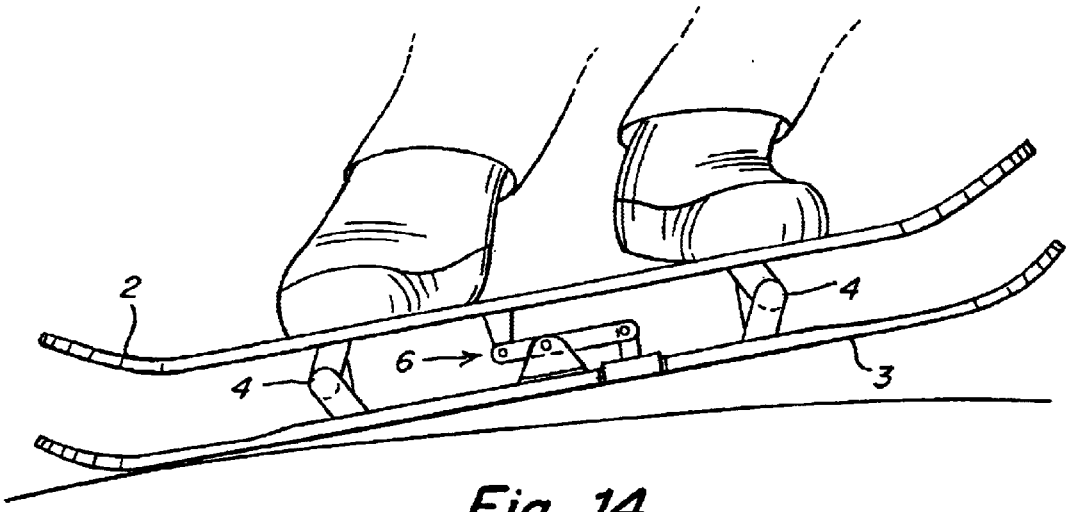
FIG. 14 is a side view of a snowdeck having a braking device that operates in accordance with a separation between the top deck and the runner.

In another illustrative embodiment, a braking feature may be controlled based on a distance between at least a portion of an upper surface that supports a rider and a lower surface that contacts a gliding surface. For example, FIG. 14 shows a snowdeck 1 having at least one spacer 4 that allows the deck 2 and the runner 3 to move toward and away from each other. For example, the spacers 4 may include a spring-supported suspension system. Each of the spacers 4 may include a hinged connection between the deck 2 and the runner 3 that allows the deck 2 and runner 3 to move toward each other. A compression spring may also be provided at each spacer 4 to urge the deck 2 and runner 3 to return to an initial separation distance. Of course, a hinged suspension arrangement such as that shown in FIG. 14 is only one example of spacer arrangements that provide a suspension-type function. For example, the spacers 4 may include spring-biased telescoping elements that allow the deck 2 and runner 3 to move toward and away from each other, a swing arm or torsion bar suspension system or other suitable arrangement.

In this illustrative embodiment, the braking device 6 operates so that when the rider's weight is not supported on the deck 2, the spacers 4 including a suspension feature urge the deck 2 and runner 3 to move away from each other, thereby activating the braking device 6. However, when the rider's weight is supported on the top deck 2, the spacers 4 allow the deck 2 and the runner 3 to move toward each other, thereby deactivating or otherwise reducing the braking function of the braking device 6.

Figure 15:
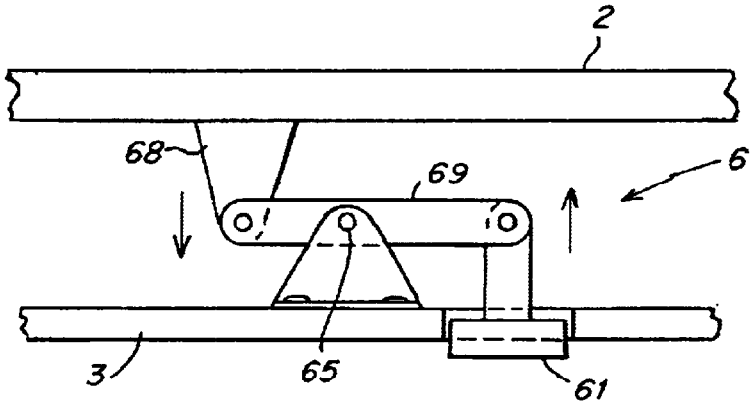
FIG. 15 shows an illustrative embodiment of a braking device that operates in accordance with top deck and runner separation.

FIG. 15 shows an illustrative embodiment of a braking device 6 that may be used in the FIG. 14 embodiment. In this embodiment, a link 68 is secured to the deck 2 and pivotally attached to one end of a lever 69. The lever 69 is pivotally attached to a hinge 65 near a mid-region of the lever 69 and is pivotally attached to a braking element 61. As the deck 2 moves toward the runner 3, the link 68 causes the lever 69 to rotate about its pivotal attachment point to the hinge 65. Rotation of the lever 69 lifts the braking element 61 relative to the runner 3, thereby deactivating the braking element 61, or otherwise reducing its resistance to motion of the snowdeck 1 on a gliding surface 10. As a result, while a rider is supported on the deck 2, the braking device 6 may be deactivated, but again activated once the rider is no longer supported on the deck 2.

Figure 16:
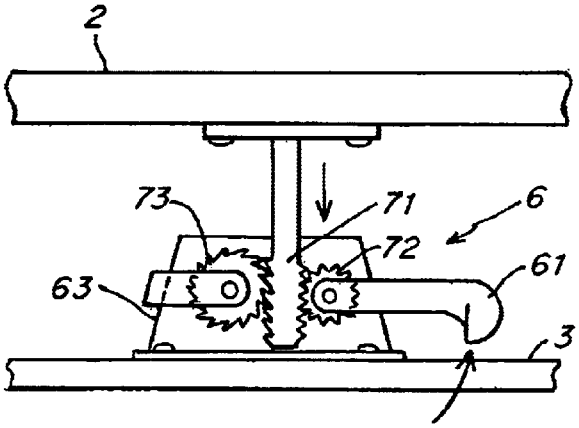
FIG. 16 shows an illustrative embodiment of a braking device that operates based on separation of a top deck portion and the runner in a snowdeck and has a brake deployment delay feature.

In another illustrative embodiment, activation of a braking device may be delayed, e.g., to allow a rider to perform tricks and other maneuvers in which the deck is substantially unweighted for a relatively short period of time and then again weighted. For example, a rider may jump up off the snowdeck 1 and again land on the snowdeck 1 after a brief period of being in the air and unsupported by the snowdeck 1. Such maneuvers may be difficult or impossible if the braking device 6 is activated as soon as the rider's weight is not supported on the deck 2. Thus, the braking device 6 may include a delay feature that prevents activation of a braking feature for a period of time after the rider's weight is no longer supported on the deck 2. For example, FIG. 16 shows a braking device 6 that incorporates a delay feature. In this illustrative embodiment, the braking device 6 includes a braking element 61 that is rotatably mounted to a housing 63. The braking element 61 may rotate so that the braking element 61 extends below the bottom surface of the runner 3 to resist movement of the snowdeck 1 on a gliding surface 10. The braking element 61 is mounted to rotate with a gear 72 that engages one side of a rack 71. The rack 71 is secured to the deck 2 and moves with the deck 2 as the deck 2 and the runner 3 move toward and away from each other. As a result, when the deck 2 and the runner 3 move toward each other, the rack 71 drives the gear 72 in a counterclockwise direction, thereby lifting the braking element 61 above the bottom surface of the runner 3. When the deck 2 and the runner 3 move away from each other, e.g., under the force of a spring or other member urging the rack 71 to move upward relative to the housing 63, the rack 71 drives the gear 72 in a clockwise direction so the braking element 61 rotates to engage the gliding surface 10.

This embodiment also includes a damper or delay element 73 that slows the activation of the braking device 6. For example, the delay element 73 in this embodiment includes a gear that engages with the rack 71. The delay element 73 is arranged so that the gear may be freely driven in the clockwise direction, but is damped to resist rotation in the counterclockwise direction. Thus, the delay element 73 may prevent rapid upward travel of the rack 71, and thus delay activation of the braking element 61. Dampening of the gear rotation in the delay element 73 may be provided by a friction device, such as a pair of stacked friction disks that are biased together and resist rotation of one disk relative to the other. One of the friction disks may be coupled to the gear in the delay element 73 by a ratchet mechanism that allows the gear to rotate in the clockwise direction without rotation of the coupled disk, but causes the gear and the disk to rotate together when the gear is driven counterclockwise. The delay element 73 may include a device by which a rider can selectively adjust the delay rate for activation of the braking element 61. For example, experienced riders may adjust the friction or other dampening of the delay element 73 to be relatively high and provide a long delay for brake activation, e.g., increase the contact force between the friction disks. Less experienced riders may adjust the dampening for the delay element 73 to be less and provide a shorter delay for brake activation.

It will be understood that the delay function of the delay element 73 may be performed by any suitable mechanism as the described friction disk arrangement is only one illustrative example. Viscous coupling devices, linear dampers, and other devices may be used to slow or otherwise delay movement of the braking element 61.

Figure 17:
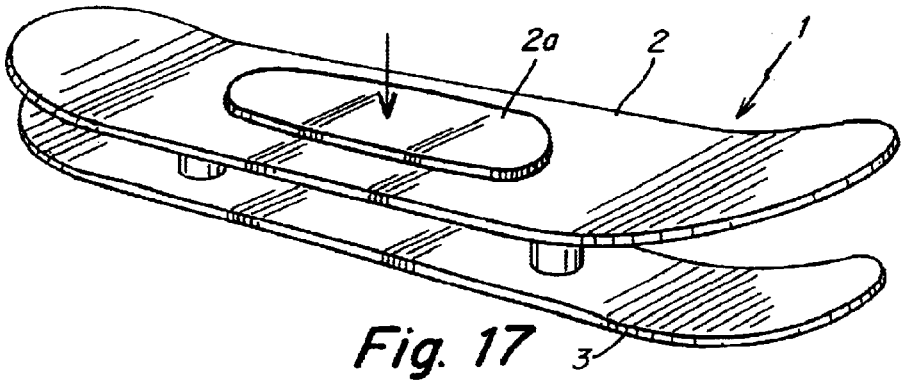
FIG. 17 is a perspective view of a snowdeck having a top deck portion that is depressible to disengage a braking device.

In the embodiments above that use a separation distance between the deck 2 and the runner 3 to control brake activation, the entire deck 2 may move toward the runner 3 to control braking. However, in other embodiments, only a portion of the deck or another element separate from the deck 2 may be moved relative to the runner 3 to control brake activation. For example, FIG. 17 shows a deck portion 2*a* that may move relative to the deck 2 and the runner 3. Movement of the deck portion 2*a* may control the activation of a braking device 6, such as that shown in FIG. 15 or 16. Thus, in such an embodiment, the spacers 4 need not have a suspension feature to allow the deck 2 to move relative to the runner 3. In embodiments that use a deck portion 2*a* to control a braking device 6, a spring or other resilient member may be used to bias the deck portion 2*a* relative to the runner 3, the braking device 6 or other reference, e.g., so that the deck portion 2*a* is urged to move away from the runner 3. For example, the embodiment shown in FIG. 16 may include a compression spring that is arranged between the deck portion 2*a* and the housing 63 to bias the deck portion 2*a* away from the housing 63 and the runner 3. Although the deck portion 2*a* shown in FIG. 17 has an oval shape, the deck portion 2*a* may have any suitable shape and/or size, and may be depressed by a rider's foot or hand.

Figure 18:
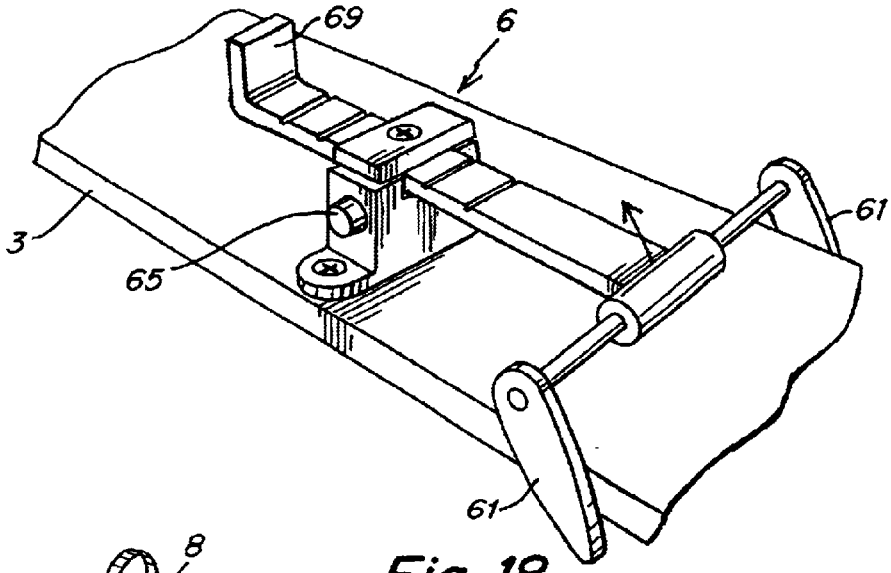
FIG. 18 is a perspective view of another illustrative embodiment of a braking device in accordance with an aspect of the invention.

In another aspect of the invention, an adjustment may be made to control the amount of force needed to deactivate a braking feature. For example, FIG. 18 shows another illustrative embodiment of a braking device 6. This illustrative embodiment includes a lever-type brake actuation feature similar to that in the embodiment shown in FIG. 15. That is, downward force on an upturned end of the lever 69 causes the lever 69 to pivot about a hinge 65, raising the opposite end of the lever 69 and the braking elements 61. However, in this embodiment, the lever 69 may be adjusted in position along the hinge 65 to allow different levels of downward force on the lever 69 to be required to deactivate the braking element 61. In addition, the hinge 65 in this embodiment incorporates a delay element that allows the lever 69 to be rotated quickly to lift the braking element 61, but delays rotation of the lever 69 to lower the braking element 61 below the bottom surface of the runner 3. As in the embodiment shown in FIG. 16, the delay may be adjusted by turning a thumb wheel or other device, e.g., to adjust a friction or other dampening setting for the delay element 73.

Figure 19:
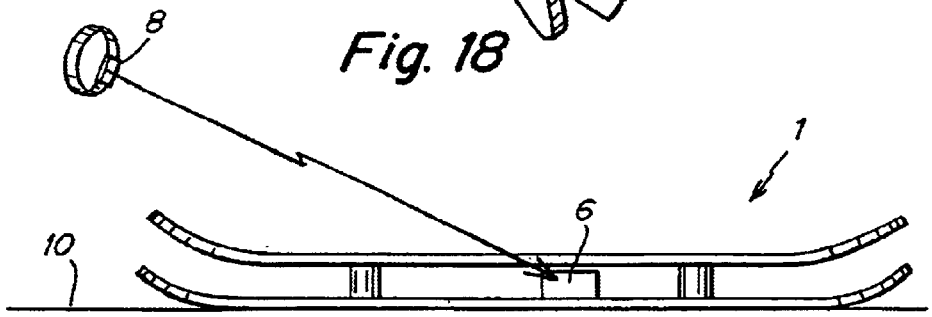
FIG. 19 is a schematic diagram of a snowdeck having a braking device that is activated based on a signal from a remote transmitter.

The embodiments shown above generally include mechanical devices that activate or deactivate a braking feature. However, in at least one embodiment, a braking feature may be electronically activated and/or deactivated. For example, FIG. 19 shows a snowdeck 1 having a braking device 6 that is electronically activated or deactivated. In this embodiment, a transmitter 8 that may be worn on the ankle or wrist of a rider transmits a signal that is received by suitable electronic circuitry in the braking device 6. When the braking device 6 determines that the transmitter 8 is within sufficient range, e.g., within 2–5 feet, the braking device 6 may be deactivated so that movement of the snowdeck 1 along the gliding surface 10 is not resisted. However, when the braking device 6 determines that the transmitter 8 is more than a threshold distance away, e.g., greater than 5 feet, the braking device 6 may be activated to resist movement of the snowdeck 1. In this embodiment, the braking device 6 may include any of the suitable braking features described above. For example, the braking device 6 may include an arrangement similar to that shown in FIG. 16. The spring loaded braking element 61 may be retracted manually by the rider, for example, by depressing a deck portion 2*a* or depressing a push button or lever on the braking device 6. Alternately, the braking device 6 may automatically deactivate the braking element 61, e.g., by operating a motor to move the braking element 61. An electronically-controlled latch may prevent movement of the braking element 61 until the transmitter 8 is determined to be out of range. At that time, the latch may be disengaged so that the braking element 61 may rotate and resist movement of the snowdeck 1 on the gliding surface 10.

Figure 20:
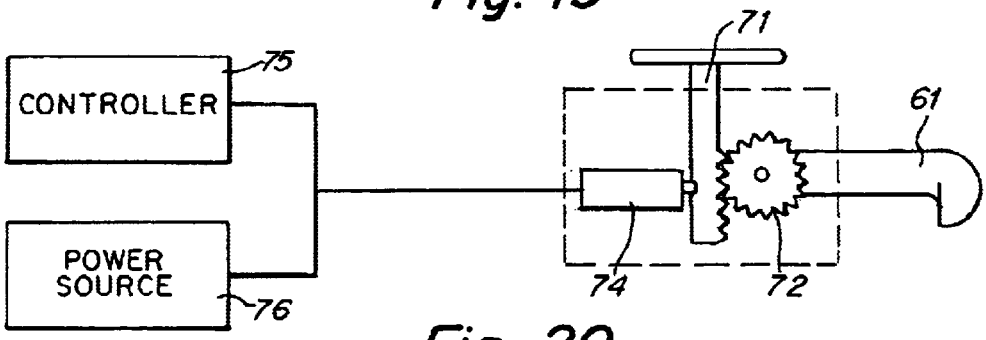
FIG. 20 is a schematic block diagram of an electronically-controlled braking device.

FIG. 20 is a schematic block diagram of an illustrative embodiment of a braking device 6 that is electronically controlled. In this embodiment, the rack 71 may be depressed, e.g., by a rider pushing down on the rack 71 with a foot or hand, to rotate the gear 72 and attached braking element 61 counterclockwise. A spring (not shown) may resist downward movement of the rack 71 and provide an energy source for activating the braking element 61. A solenoid-controlled latch 74 or other suitable element may engage with the rack 71, the gear 72 and/or the braking element 61 when the rack 71 is depressed to lock the braking element 61 in a deactivated position. Operation of the solenoid-controlled latch 74 may be performed by a controller 75 using a power source 76, e.g., a battery. The controller 75 may include suitable electronic hardware, software and/or firmware to detect signals transmitted from the transmitter 8, determine the range of the transmitter 8 and control operation of the solenoid latch 74 accordingly. Such detection hardware and software are well known and not described in detail here. For example, the transmitter 8 may constantly, or periodically, output a radio frequency signal that is detectable by the controller 75. The signal may include a code or other unique identifier so that signals sent from other transmitters or emission sources do not affect the operation of the braking device 6. The controller 75 may use a proximity detection scheme such that if the power of the signal received from the transmitter 8 falls below a threshold level (e.g., indicating that the transmitter 8 is more than a threshold distance away), the controller 75 may disengage the latch 74 and allow the braking element 61 to rotate clockwise and resist movement of the snowdeck 1 along the gliding surface 10.

It should be understood that the illustrative embodiment of an electronically controlled braking device 6 described above is only one of several possible arrangements. For example, the controller 75 need not detect signals from a remote transmitter 8, but instead may detect the physical presence of a passive device, such as a magnet stuck to a housing 63 of the braking device 6. A string or other tether may connect the magnet to the rider so that if the rider is separated from the snowdeck, the magnet is pulled from the housing 63. The controller 75 may activate the braking device 6 when the presence of the magnet is no longer detected. Such safety-type kill switches are commonly found in exercise and other equipment. The controller 75 may also control the braking device 6 based on detected pressure, e.g., indicating the presence of the rider on the deck 2, or other detectable conditions that indicate the rider is using the snowdeck 1.

Although particular embodiments are described above in detail, various modifications and improvements will readily occur to those skilled in the art. Such modifications and improvements are intended to be part of this disclosure and within the spirit and scope of the invention. Accordingly, the description of the illustrative embodiments is by way of example only, and the invention is defined, at least in part, by the following claims and their equivalents.

What is claimed is:

1. A gliding device comprising:

an upper surface constructed and arranged to support a rider's feet while the rider is standing;

a bottom surface adapted to contact a gliding surface;

a braking feature that resists movement of the gliding board along the gliding surface when the rider is not supported by the upper surface; and a delay element, distinct from the braking feature, that operates to actively delay activation of the braking feature for a period of time after the rider is not supported by the upper surface.

2. The gliding device of claim 1, wherein the braking feature comprises a flexible element adapted to contact the gliding surface.

3. The gliding device of claim 1, wherein the braking feature comprises:

a housing fixed relative to the bottom surface;

a resilient member supported by the housing; and a braking element that is urged by the resilient member into contact wit the gliding surface.

4. The gliding device of claim 1, wherein the braking feature comprises:

a hinge;

a frame pivotally mounted to the hinge; and at least one braking element secured to the frame.

5. The gliding device of claim 4, further comprising:

at least one arm attached to the frame, the at least one arm causing the frame to rotate at a pivot with the hinge when the arm is contacted by the gliding surface.

6. The gliding device of claim 5, wherein the hinge is fixed relative to the bottom surface and the at least one arm and the at least one braking element extend from the frame below the bottom surface.

7. The gliding device of claim 1, wherein the upper surface and the bottom surface move toward each other, and the braking feature is deactivated when the upper surface and the lower surface move toward each other.

8. The gliding device of claim 1, further comprising:

a suspension that attaches the upper surface and the lower surface together and allows the upper surface and the bottom surface to move toward each other; and the braking feature includes a braking device that activates a braking element when the upper surface and the bottom surface are a first distance apart, and deactivates the braking element when the upper surface and the bottom surface are a second distance apart.

9. The gliding device of claim 1, wherein the braking feature comprises:

a lever pivotally mounted relative to the bottom surface; and a braking element pivotally mounted to one end of the lever;

wherein the braking element is moved relative to the bottom surface by rotation of the lever relative to the bottom surface.

10. The gliding device of claim 1, wherein the braking feature comprises:

a controller that selectively activates a braking element based on a position of the rider relative to the bottom surface.

11. The gliding device of claim 1, wherein the braking feature comprises:

a braking element movable between a first deactivated position and a second activated position in which the braking element resists movement of the bottom surface along the gliding surface;

a latch that selectively maintains the braking element in the first position; and a controller that electronically controls the latch based on a signal indicative of a position of the rider relative to the bottom surface.

12. A gliding device for supporting a rider when sliding on a surface, comprising:

a runner having an upturned end, a middle portion and a bottom surface that contacts a gliding surface;

a deck elevated from the runner, the deck having an upper surface that supports a rider and a longitudinal axis;

a spacer secured to the runner and to the deck so that forces applied by a rider on the deck are transmitted to the runner;

a braking feature that resists movement of the gliding device sliding on the gliding surface; and a delay element that operates to actively delay activation of the braking feature for a period of time after the rider is not supported by the deck.

13. The gliding device of claim 12, wherein the braking feature includes a hinge that interconnects at least a portion of the deck and the runner and allows the portion of the deck to move relative to the runner.

14. The gliding device of claim 12, wherein the braking feature comprises a flexible element adapted to contact the gliding surface.

15. The gliding device of claim 12, wherein the braking feature comprises:

a housing fixed relative to the bottom surface of the runner;

a resilient member supported by the housing; and a braking element that is urged by the resilient member into contact with the gliding surface.

16. The gliding device of claim 12, wherein the braking feature comprises:

a hinge;

a frame pivotally mounted to the hinge; and at least one braking element secured to the frame.

17. The gliding device of claim 16, further comprising:

at least one attn attached to the frame, the at least one arm causing the frame to rotate at a pivot with the hinge when the arm is contacted by the gliding surface.

18. The gliding device of claim 17, wherein the hinge is fixed relative to the bottom surface of the runner, and the at least one arm and the at least one braking element extend from the flame below the bottom surface of the runner.

19. The gliding device of claim 12, wherein the upper surface of the deck and the bottom surface of the runner are arranged to move toward each other, and the braking feature is deactivated when the upper surface and the lower surface move toward each other.

20. The gliding device of claim 12, wherein the spacer comprises a suspension that attaches the deck and the runner together and allows the deck and the runner to move toward each other; and the braking feature includes a braking device that activates a braking element when the deck and the runner are a first distance apart, and deactivates the braking element when the deck and runner are a second distance apart.

21. The gliding device of claim 12, wherein the braking feature comprises:

a lever pivotally mounted relative to the bottom surface of the runner; and a braking element mounted to one end of the lever;

wherein the braking element is moved relative to the bottom surface of the runner by rotation of the lever relative to the bottom surface.

22. The gliding device of claim 12, wherein the braking feature comprises:

a controller that selectively activates a braking element based on a position of the rider relative to the bottom surface.

23. The gliding device of claim 12, wherein the braking feature comprises:

a braking element movable between a first deactivated position and a second activated position in which the braking element resists movement of the bottom surface along the gliding surface;

a latch that selectively maintains the braking element in the first position; and a controller that electronically controls the latch based on a signal indicative of a position of the rider relative to the bottom surface.

24. A gliding device for supporting a rider when sliding on a surface, comprising:

an upper surface constructed and arranged to support a rider's feet while the rider is standing;

a bottom surface adapted to contact a gliding surface;

a braking feature that resists movement of the gliding device sliding on the gliding surface, the braking feature being controlled based on a force urging the bottom surface into contact with the gliding surface; and a delay element, distinct from the braking feature, that operates to actively delay activation of the braking feature for a period of time after the rider is not supported by the deck.

25. A gliding device for supporting a rider when sliding on a surface, comprising:

a runner having an upturned end, a middle portion and a bottom surface that contacts a gliding surface;

a deck elevated from the runner, the deck having an upper surface that supports a rider;

a spacer secured to the runner and to the deck so that forces applied by a rider on the deck are transmitted to the runner;

a braking feature that resists movement of the gliding device sliding on the gliding surface, the braking feature being controlled based on a separation distance between a portion of the deck and a portion of the runner; and a delay element, distinct from the braking feature, that operates to actively delay activation of the braking feature for a period of time after the rider is not supported by the deck.

26. A gliding device for supporting a rider when sliding on a surface, comprising:

an upper surface constructed and arranged to support a rider's feet while the rider is standing;

a bottom surface adapted to contact a gliding surface; and a braking feature that includes a braking element that resists movement of the gliding device sliding on the gliding surface, the braking feature including a damper that operates to actively slow movement of the braking element for a period of time after the rider is no longer supported by the deck.

27. A gliding device for supporting a rider when sliding on a surface, comprising:

a runner having an upturned end, a middle portion and a bottom surface that contacts a gliding surface;

a deck elevated from the runner, the deck having an upper surface that supports a rider and a longitudinal axis;

a spacer secured to the runner and to the deck so that forces applied by a rider on the deck are transmitted to the runner;

braking means for resisting movement of the gliding device on the gliding surface; and delay means for actively delaying activation of the braking feature for a period of time after the rider is not supported by the deck.

28. A method for resisting movement of a snowdeck, comprising:

providing a snowdeck having a single runner with a bottom surface that contacts a gliding surface, a deck elevated from the runner, and a spacer secured to the runner and to the deck so that forces applied by a rider on the deck are transmitted to the runner; and resisting movement of the gliding device on the gliding surface based on a distance between a portion of the deck and a portion of the runner.

29. A method for resisting movement of a snowdeck, comprising:

providing a snowdeck having a single runner with a bottom surface that contacts a gliding surface, a deck elevated from the runner, and a spacer secured to the runner and to the deck so that forces applied by a rider on the deck are transmitted to the runner; and delaying resisting movement of the gliding device on the gliding surface for a period of time after the rider is no longer supported on the deck.

30. A method for resisting movement of a snowdeck, comprising:

providing a snowdeck having a single runner with a bottom surface that contacts a gliding surface, a deck elevated from the runner, and a spacer secured to the runner and to the deck so that forces applied by a rider on the deck are transmitted to the runner; and resisting movement of the gliding device on the gliding surface based on determining a position of the rider relative to the deck.

* * * * *